US006113421A

United States Patent [19]

Daoud

[11] Patent Number: 6,113,421

[45] Date of Patent: Sep. 5, 2000

[54] STRAIN RELIEF MECHANISM FOR AN INSULATION DISPLACEMENT CONNECTOR

[75] Inventor: Bassel H. Daoud, Parsippany, N.J.

[73] Assignee: Lucent Technologies Inc., Murray Hill, N.J.

[21] Appl. No.: 09/218,058

[22] Filed: Dec. 21, 1998

[51] Int. Cl.[7] ..... H01R 13/58

[52] U.S. Cl. ..... 439/459; 439/409

[58] Field of Search ..... 439/409, 410, 439/417, 459, 456

[56] References Cited

U.S. PATENT DOCUMENTS

| | | | |
|---|---|---|---|
| 3,611,264 | 10/1971 | Ellis . | |
| 4,426,125 | 1/1984 | Crawford | 439/409 |
| 4,662,699 | 5/1987 | Vachhani et al. . | |
| 4,793,823 | 12/1988 | Cozzens et al. | 439/409 |
| 5,217,389 | 6/1993 | MacKay et al. | 439/459 |
| 5,240,432 | 8/1993 | Daoud | 439/417 |
| 5,435,747 | 7/1995 | Franckx et al. | 439/409 |
| 5,637,011 | 6/1997 | Meyerhoefer et al. | 439/409 |
| 5,860,829 | 1/1999 | Hower et al. | 439/417 |

OTHER PUBLICATIONS

Technical Data Sheet of A.C. Egerton Limited, related to Mini Rocker Cross Connection Cabinets.

*Primary Examiner*—Gary F. Paumen
*Attorney, Agent, or Firm*—Stroock & Stroock & Lavan LLP

[57] ABSTRACT

A strain relief for an insulation displacement connector contains a cap section, a base section, and a base tab. The cap section is movable between an open position and a closed position and has a wire insertion channel for guidedly receiving a wire. The channel has an entrance aperture for entry of the wire into the channel. The open position facilitates entry of the wire into the channel. The base tab is upstanding from the base section and extends into the wire insertion channel when the cap is in the closed position. In this orientation, the wire in the channel is forced by the base tab into contact with a portion of an inner wall of the channel thereby forming a friction fit therebetween. Thus, the wire is restrained in the channel and strain relieved.

24 Claims, 4 Drawing Sheets

STRAIN RELIEF MECHANISM FOR AN INSULATION DISPLACEMENT CONNECTOR

FIELD OF THE INVENTION

This invention relates generally to the field of telephone wire connectors and distribution systems, and specifically to a strain relief mechanism for an insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971. Also widely available are tool-less IDC's known as Mini-Rocker Connectors such as these sold by A. C. Egerton Ltd., which hold a tip ring wire pair in terminals retained under a single moveable cap through which both wires of the pair are inserted.

The tip and ring wires held within such tool-less IDC connectors are strain relieved only to the extent held by the compressive force exerted by the IDC terminal holding the bare wire which has been stripped of its insulation layer. While this prior art IDC works for its intended purpose, a significant drawback to this prior art IDC is that when a pulling force is applied to the tip or ring wire, the wire is easily stripped and disconnected from the terminal.

SUMMARY OF THE INVENTION

The present invention is directed at overcoming shortcomings in the prior art. Generally speaking, in accordance with the present invention, a strain relief mechanism for an IDC comprises a cap section, a base section, and a base tab. The cap section is movable between an open position and a closed position and has a wire insertion channel for guidedly receiving a wire. The wire insertion channel has an entrance aperture for entry of the wire. The base tab is upstanding from the base section and extends into the wire insertion channel when the cap section is in the closed position. In this orientation, the wire in the wire insertion channel is forced by the base tab into contact with a portion of an inner wall of the wire insertion channel by the base tab, thereby forming a friction fit therebetween. This results in the wire being restrained in the wire insertion channel and thereby strain relieved.

In an alternate embodiment, the wire insertion channel also includes a retention cavity which is disposed opposite the base tab when the latch member is in the engaged position. In this embodiment, when the cap section is moved into the closed position with the wire in the wire insertion channel, the wire is forced by the base tab into contact with the inner wall of the retention cavity, thereby forming a bend and pressure fit. The wire is restrained in the wire insertion channel and thereby provides strain relief.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
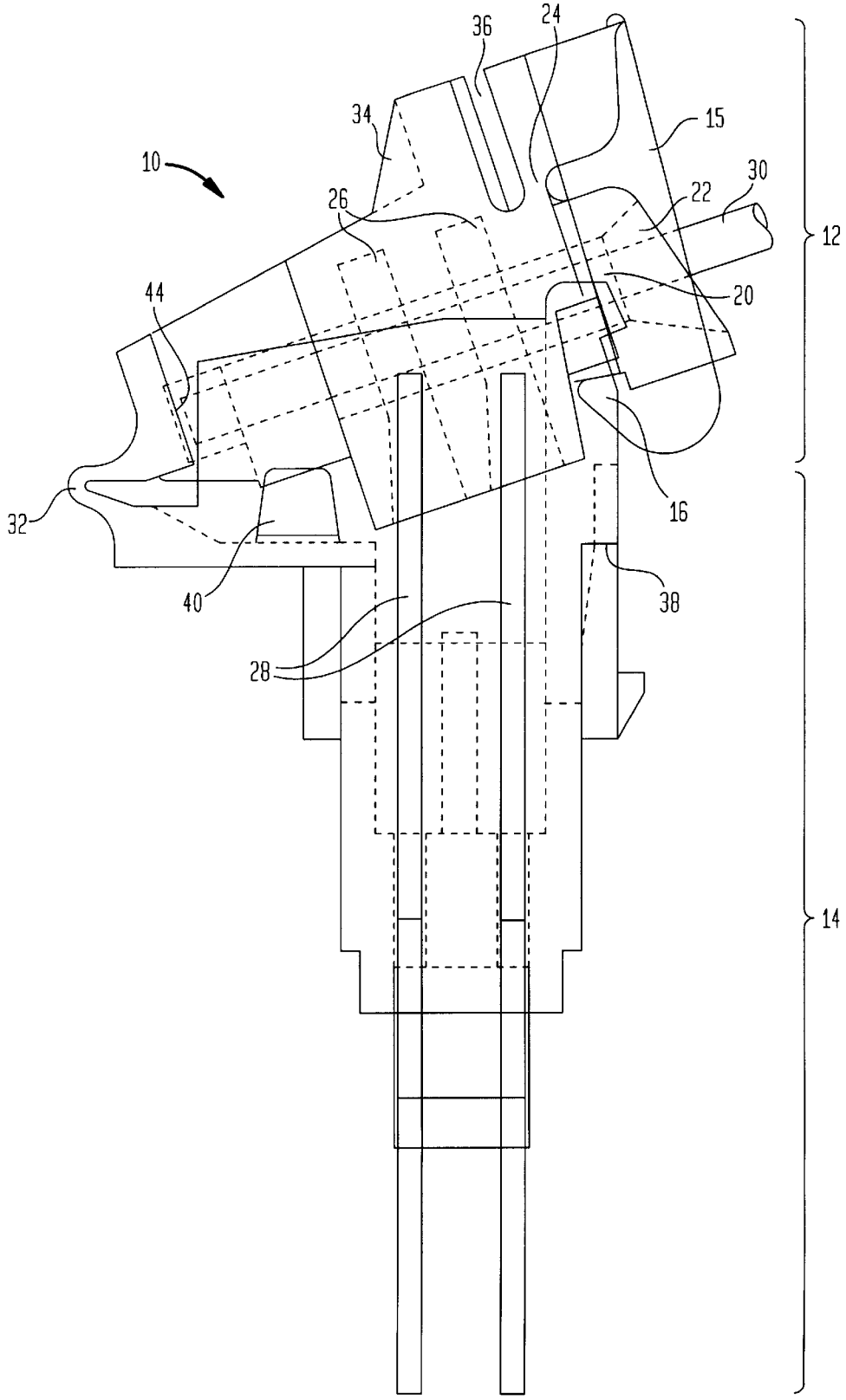
FIG. 1 is a side elevational view of a connector constructed in accordance with a preferred embodiment of the present invention with the cap section in the open position.
Figure 2:
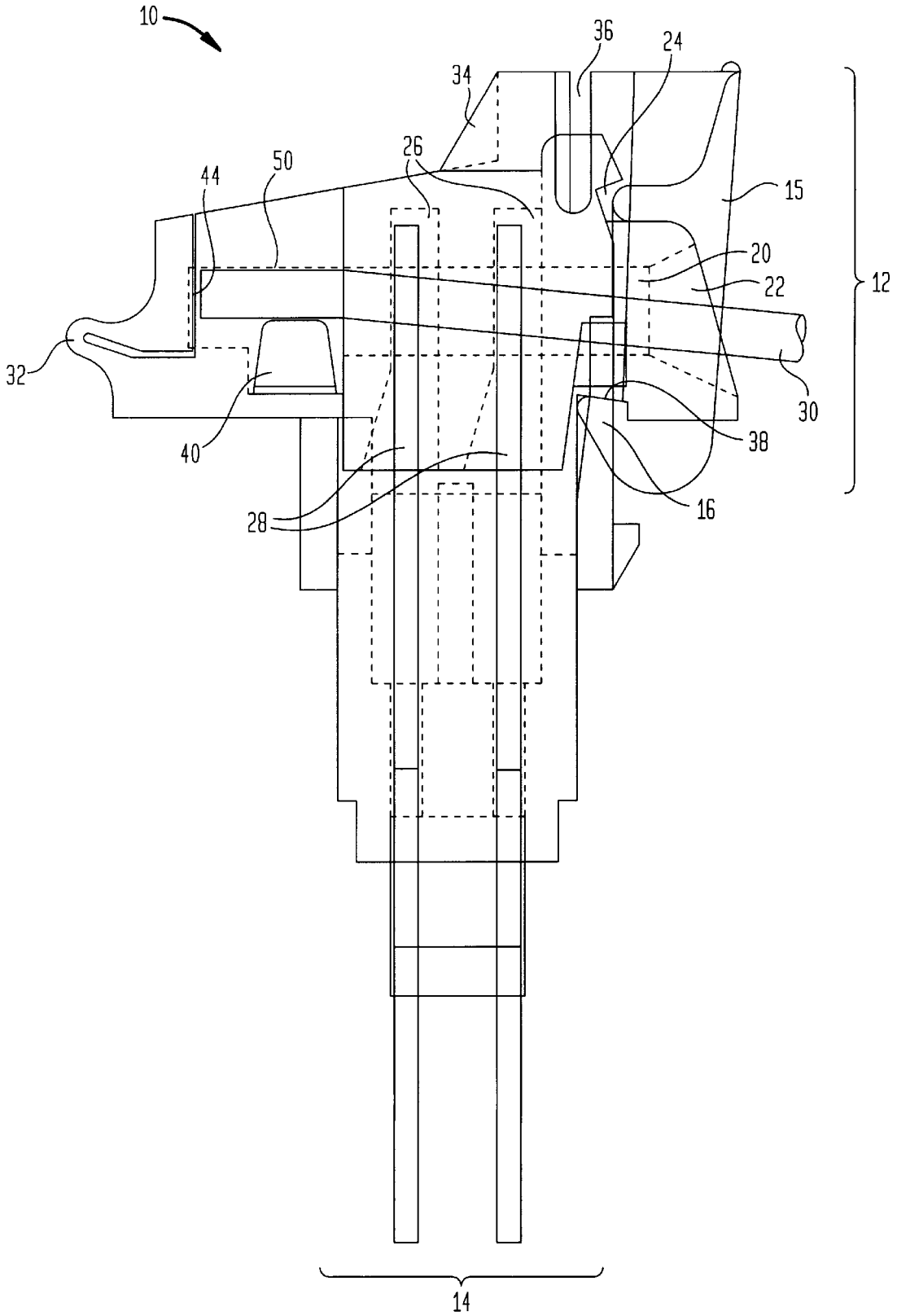
FIG. 2 is a side elevational view of the connector of FIG. 1 with the cap section in the closed position.

Reference is first made to FIGS. 1–2, which illustrate an insulation displacement connector of the present invention generally indicated as 10. Connector 10 has a cap section, generally indicated as 12, and a base section, generally indicated as 14. Cap section 12 is connected to base section 14 at a pivot point 32. Cap section 12 pivots about pivot point 32 and is movable between an open position, as illustrated in FIG. 1, and a closed position, as illustrated in FIG. 2. Base section 14 is generally fixed to a base of some kind, such as, for example, a connector block or other mounting surface. (Not shown).

Cap section 12 includes a latch 15 which is movable between an engaged position, as illustrated in FIG. 2, and a disengaged position, as illustrated in FIG. 1. Latch 15 includes a latch engaging portion 16. Base section 14 includes a latch retaining portion 38. When cap section 12 is in the closed position, latch 15 is in the engaged position. In this orientation, latch engaging portion 16 engages latch retaining portion 38 thereby maintaining cap section 12 in the closed position. In order to open cap section 12, latch 15 must first be moved to the disengaged position, in a manner known in the art.

Movement of latch 15 between the engaged and disengaged positions can be accomplished by gripping connector 10 between a finger grip member 34 and latch 15. Upon the application of pressure, latch 15 pivots about living hinge 24 towards recess 36. By applying sufficient pressure such that latch 15 is pivoted about living hinge 24 by a sufficient distance, latch engaging portion 16 can be disengaged from latch retaining portion 38 and cap section 12 can be moved into the open position.

Cap section 12 of connector 10 has at least one wire insertion channel 20. Generally, cap section 12 of connector 10 comprises two wire insertion channels 20 as known in the art, one for each wire of a tip ring pair. Although the discussion here will focus on one wire insertion channel, cap section 12 of connector 10 may contain a plurality of wire insertion channels 20. Each wire insertion channel 20 includes an entrance aperture 22 and a wire stop surface 44. Wire insertion channel 20 is constructed so as to be capable of receiving and holding any ordinary telephone wire 30 of a type known in the art. Cap section 12 of connector 10 also includes terminal strip receiving portions 26, which are constructed so as to be capable of accepting therewithin terminal strips 28 when cap section 12 is in the closed position. Terminal strips 28 are located in base section 14 of connector 10 in a manner known in the art.

With cap section 12 of connector 10 in the open position, terminal strips 28 are out of full registration with terminal strip receiving portions 26 and do not intersect wire insertion channel 20. However, when cap section 12 is in the closed position, as illustrated in FIG. 2, terminal strips 28 are received in terminal strip receiving portions 26 and intersect wire insertion channel 20. Base section 14 of connector 10 includes a base tab 40. When cap section 12 is in the open position, base stop 40 does not intersect wire insertion channel 20. However, when cap section 12 is in the closed position, base stop 40 intersects wire insertion channel 20, as illustrated in FIG. 2.

In use, with cap section 12 of connector 10 in the open position, wire 30 is passed into wire insertion channel 20 through entrance aperture 22 until it abuts with wire stop surface 44. When so inserted, wire 30 is retained in wire insertion channel 20 at a first orientation as illustrated in FIG. 1.

Reference is again made to FIG. 2 which depicts connector 10 with cap section 12 in the closed position. The closed position is achieved by pushing cap section 12 in a downward direction towards base section 14. When cap section 12 is pushed into the closed position, wire 30 is driven into contact with terminal strip 28 whereupon it is stripped of insulation and mechanically and electrically coupled to terminal strip 28 within connector 10 in a manner known in the art. In the closed position, terminal strips 28 are housed in terminal strip receiving portions 26 as illustrated in FIG. 2.

Also, in the closed position, base tab 40 intersects wire insertion channel 20 and thereby causes wire 30 to be pushed against the inner wall of wire insertion channel 20 at a pressure zone 50. The pressure applied by base tab 40 on wire 30 provide strong resistance to any pulling force that may be applied to wire 30. Thus, resistance to any pulling force on wire 30 is provided by base tab 40 and pressure zone 50, and not merely by the compressive force exerted by terminal strip 28 on the portion of wire 30 gripped thereby. Pressure zone 50 sustains the brunt of any pulling force that may be applied to wire 30. Consequently, the wire portion retained within terminal strip 28 is relieved from any strain which may result from the application of a pulling force on wire 30. Thus, this mechanism provides for strong strain relief for connector 10. Connector 10, along with cap section 12, is preferably, although not necessarily designed in such a manner that wire 30 will break before it is released at pressure zone 50 and slides out of entrance aperture 22. This provides for an efficient strain relief mechanism for connector 10. In a preferred embodiment, base tab 40 may be removably attached to base section 14 of connector 10. Of course, base tab 40 may also be integrally formed as part of the connector 10, such as for example as part of a molded feature.

Additionally, wire insertion channel 20 may be shaped and sized to provide additional retention of wire 30 through frictional engagement of wire 30 and the interior surface of wire insertion channel 20, provided that the friction introduced is not unduly high, so as to avoid the introduction of strain on wire 30 as cap section 12 of connector 10 is moved from the open position to the closed position. Base tab 40 may be made of a variety of materials recognized by the person of skill as suitable to such an application, including for example rubber, plastic, metal, wood, acrylic and fiberglass. Thus, base tab 40 may be made of conductive or non-conductive materials.

Figure 3:
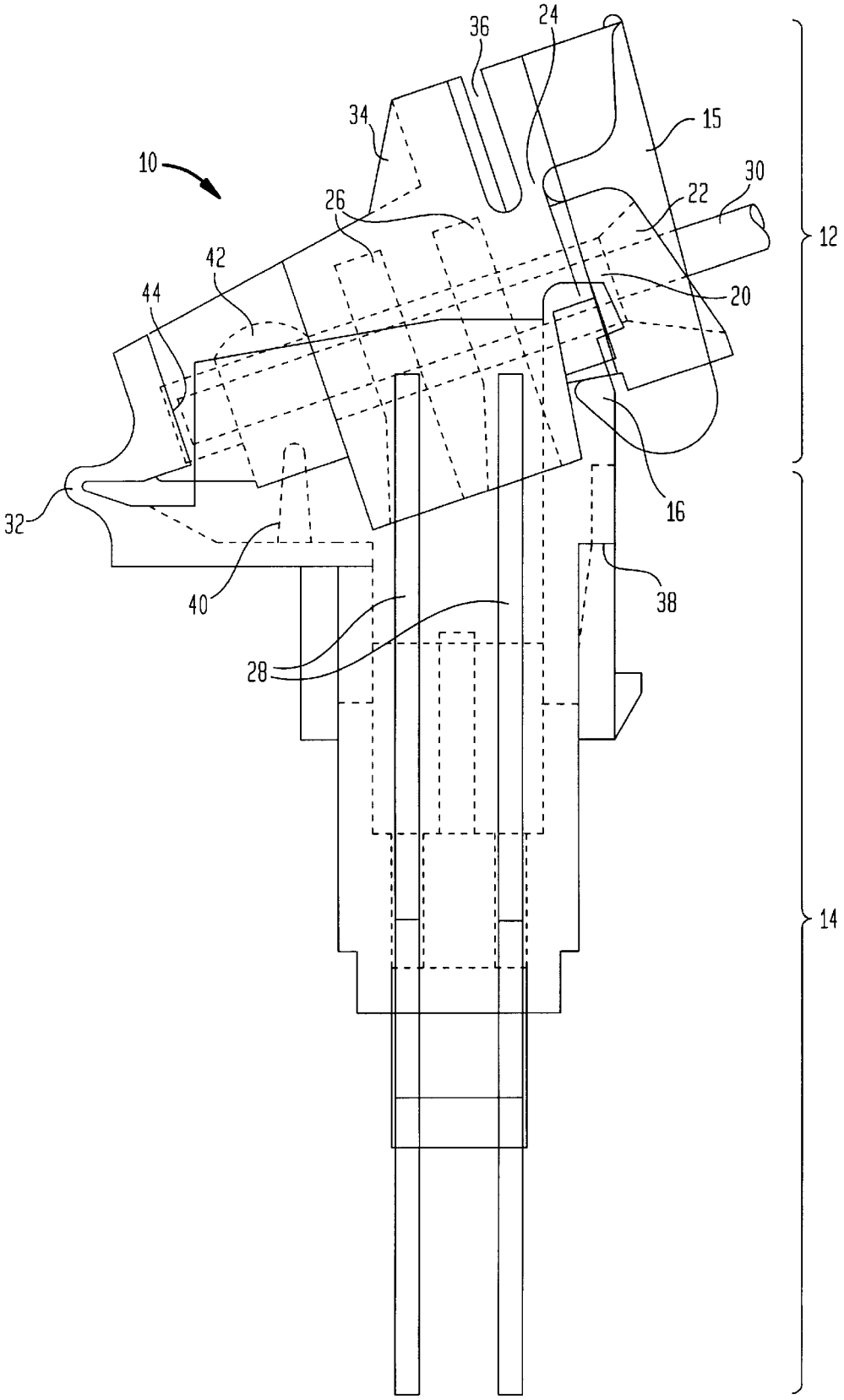
FIG. 3 is a side elevational view of a connector constructed in accordance with an alternate embodiment of the present invention with the cap section in the open position.
Figure 4:
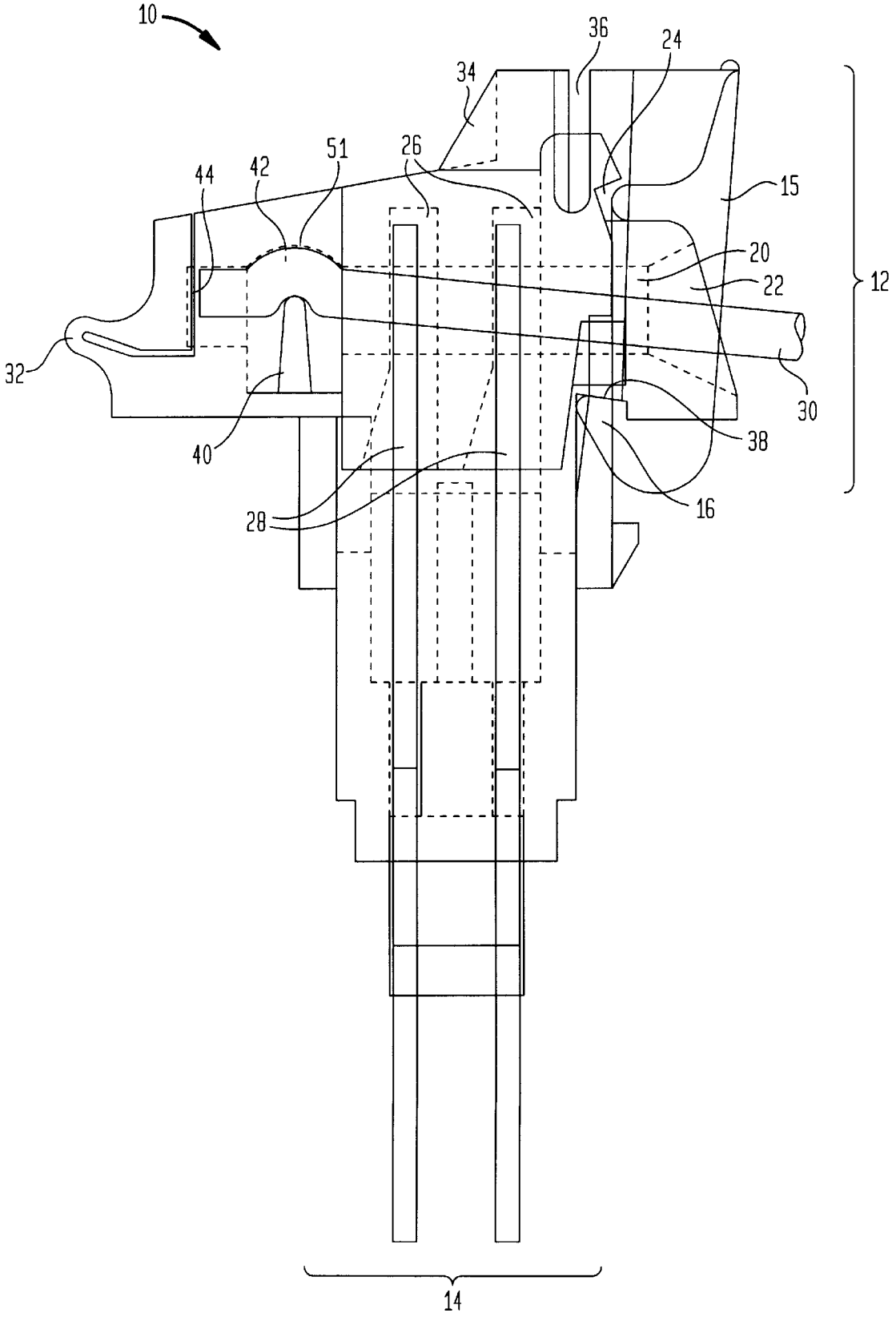
FIG. 4 is a side elevational view of the connector of FIG. 3 with the cap section in the closed position.

Reference is now made to FIGS. 3–4 which illustrate another embodiment of connector 10 constructed in accordance with the present invention. FIG. 3 illustrates cap section 12 of connector 10 in a open position whereas FIG. 4 illustrates cap section 12 in the closed position, as described above. In this embodiment, wire insertion channel 20 further includes a retention cavity 42 which is located opposite base tab 40 when cap section 12 is in the closed position.

In use, with cap section 12 of connector 10 in the open position, wire 30 is inserted into wire insertion channel 20 through entrance aperture 22 until it abuts with wire stop surface 44. In this orientation, the inner wall of wire insertion channel 20 and wire 30 define retention cavity 42. When cap section 12 is subsequently moved into the closed position, as illustrated in FIG. 4, base tab 40 intersects with wire insertion channel 20. As a result, base tab 40 pushes a portion of wire 30 into retention cavity 42. This results in a bending of wire 30 and an exertion of pressure on the inner wall of retention cavity 42 at a pressure zone 51. Thus, when cap section 12 is in the second position, wire 30 is firmly contained in wire insertion channel 20 and provides strong resistance to any pulling force that may be applied on wire 30. Resistance to any pulling force on wire 30 is provided by the portion of wire 30 contained in retention cavity 42 and not by the compressive force exerted by terminal strip 28 on wire 30. Pressure zone 51, where wire 30 is bent and held in retention cavity 42 due to the pressure exerted by base tab 40, sustains the brunt of any pulling force that may be applied to wire 30. Consequently, the portion of wire 30 retained within terminal strip 28 is relieved from any strain which may result from the application of a pulling force on wire 30. Thus, this mechanism provides for strong strain relief for connector 10.

Cap section 12 and base section 14 may be formed of any art-recognized material having the proper insulating and mechanical properties. Preferably, plastic is employed. Further, base tab 40 may be integrally formed on base section 14, or may be a separate part that is fixedly attached to base section 14, as by screwing, gluing or the like, or may be selectively removably attachable to base section 14 as by snap fitting, compression fitting, screwing or the like. In this manner, a connector array as known in the art can be customized to have some or all connectors strain relieved, as a matter of application specific design choice. Thus, the connector of the present invention may be used on a connector block wherein selective connectors on the connector block are strain relieved. Further, the connector of the present invention may be used in a wiring enclosure, such as, for example, a Building Entrance Protector (BEP) or Network Interface Unit (NIU).

In all embodiments, terminal strip 42, 242 may be formed of any commonly known conductive metal known in the art and suitable for use in such terminals, such as, for example, platinum washed phosphor bronze, or beryllium-copper alloy or other metal or alloy combining good electrical conductivity with sufficient mechanical strength and resilience. Similarly, connector block 14 is preferably formed of a molded synthetic resinous material with good insulating properties and mechanical strength, as are caps 38. The specific materials utilized in constructing connector block 14 and caps 38 are an application specific matter of design choice within the knowledge of the person of skill familiar with terminal blocks utilized in the telephony art. Moreover, the specific means of affixing terminal 42 within block 14 need not be solely by snap fitting as described above, but by numerous methods of affixation known in the art, such as adhesives, friction fitting, integral molding, and the like, depending on whether ready removal and re-insertion of the terminal is required, as a matter of application specific design choice.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A strain relief for a wire retained in an insulation displacement connector comprising:

a cap section and a base section, said cap section being movable between an open position and a closed position, said cap section having therein at least one wire insertion channel for guidedly receiving a wire, said channel having an entrance aperture for entry of said wire, said open position facilitating entry of said wire in said channel;

said channel further comprising a wire stop surface such that an extent of entry of said wire is limited by abutment with said wire stop surface;

said base section comprising a terminal strip for electrical mating with said wire when said cap is in said closed position; and a base tab upstanding from said base section and oriented between said stop surface and said terminal strip and extending into said channel when said cap is in said closed position such that said wire in said channel is forced by said base tab into contact with a portion of an inner wall of said channel forming a friction flit therebetween, said wire thus being restrained in said channel and strain relieved thereby.

2. The strain relief of claim 1, further comprising a latch member movable between an engaged position and a disengaged position, said latch member maintaining said cap section in said closed position when said latch member is in said engaged position.

3. The strain relief of claim 1, wherein said cap section includes a finger grip member for facilitating movement of said cap section from said open position to said closed position and vice versa.

4. The strain relief of claim 1, wherein said cap section and said base section are connected at a pivot point such that said cap section pivots about a living hinge.

5. The strain relief of claim 1, wherein said base tab is selectively removeably attachable to said base section.

6. The strain relief of claim 1, wherein said wire insertion channel is so sized and shaped as to introduce an amount of friction between said wire and a portion of said channel for providing additional strain relief.

7. The strain relief of claim 1, wherein said base tab is made of a material selected from a group of materials consisting of rubber, plastic, metal, wood, acrylic and fiberglass.

8. The strain relief of claim 1, wherein said base tab is made of a nonconductive material.

9. The strain relief of claim 1, wherein said cap section comprises one or more terminal strip receiving portions.

10. The strain relief of claim 1, wherein said wire insertion channel intersects said terminal strip in said closed position.

11. A strain relief for a wire retained in an insulation displacement connector comprising:

a cap section and a base section, said cap section being movable between an open position and a closed position said cap section having therein at least one wire insertion channel for guidedly receiving a wire, said channel having an entrance aperture for entry of said wire, and a retention cavity, said open position facilitating entry of said wire in said channel;

said channel further comprising a wire stop surface such that an extent of entry of said wire is limited by abutment with said wire stop surface;

said base section comprising a terminal strip for electrical mating with said wire when said cap is in said closed position; and a base tab upstanding from said base section and oriented between said stop surface and said terminal strip and extending into said channel when said cap is in said closed position such that said wire in said channel is forced by said base tab into contact with a portion of an inner wall of said retention cavity, said wire being bent by said contact for forming a bend and pressure fit to strain relieve said wire.

12. The strain relief of claim 11 further comprising a latch member movable between an engaged position and a disengaged position, said latch member maintaining said cap section in said closed position when said latch member is in said engaged position, said retention cavity being disposed opposite said base tab in said engaged position.

13. The strain relief of claim 11, wherein said cap section includes a finger grip member for facilitating movement of said cap section from said open position to said closed position and vice versa.

14. The strain relief of claim 11, wherein said cap section and said base section are connected at a pivot point such that said cap section pivots about a living hinge.

15. The strain relief of claim 11, wherein said base tab is selectively removeably attachable to said base section.

16. The strain relief of claim 11, wherein said wire insertion channel is so sized and shaped as to introduce an amount of friction between said wire and a portion of said channel for providing additional strain relief.

17. The strain relief of claim 11, wherein said base tab is made of a material selected from a group of materials consisting of rubber, plastic, metal, wood, acrylic and fiberglass.

18. The strain relief of claim 11, wherein said base tab is made of a non-conductive material.

19. The strain relief of claim 11, wherein said cap section comprises one or more terminal strip receiving portions.

20. The strain relief of claim 11, wherein said wire insertion channel intersects said terminal strip in said closed position.

21. The strain relief of claim 1, wherein said insulation displacement connector is disposed on a connector block.

22. The strain relief of claim 1, wherein said insulation displacement connector in disposed in a wiring enclosure.

23. The strain relief of claim 11, wherein said insulation displacement or is disposed on a connector block.

24. The strain relief of claim 11, wherein said insulation displacement or is disposed in a wiring enclosure.

* * * * *